US007048616B1

(12) United States Patent
Gardzinski et al.

(10) Patent No.: US 7,048,616 B1
(45) Date of Patent: May 23, 2006

(54) GRINDING APPARATUS FOR GRINDING AN OUT-OF-ROUND TRUNNION OR TIRE FOR A ROTARY KILN

(75) Inventors: Martin A. Gardzinski, Red Wing, MN (US); Donato L. Ricci, W8477-162nd Ave., Hager City, WI (US) 54017

(73) Assignee: Donato L. Ricci, Hager City, WI (US)

( * ) Notice: Subject to any disclaimer, the term of this patent is extended or adjusted under 35 U.S.C. 154(b) by 0 days.

(21) Appl. No.: 10/991,821

(22) Filed: Nov. 18, 2004

(51) Int. Cl.
*B24B 1/00* (2006.01)

(52) U.S. Cl. ..... 451/49; 451/14; 451/142

(58) Field of Classification Search ..... 451/48, 451/49, 51, 57, 59, 131, 142, 259, 272, 348, 451/424–427, 258, 146, 14
See application file for complete search history.

(56) References Cited

U.S. PATENT DOCUMENTS 3,466,808 A * 9/1969 Mess ..... 451/236
4,488,382 A * 12/1984 Zajac et al. ..... 451/26
6,298,571 B1 * 10/2001 Dall'Aglio et al. ..... 33/555.1

* cited by examiner

*Primary Examiner*—Dung Van Nguyen
(74) *Attorney, Agent, or Firm*—Nikolai & Mersereau, P.A.

(57) ABSTRACT

The present invention relates to a grinding apparatus for grinding an out-of-round trunnion tire for a rotating kiln. The present invention is mounted on a trunnion roller such that a tracking wheel and a grinder are in tangent with the out-of-round trunnion tire. The mounting bracket supports a means for angling the grinder so that it is in tangent with the out-of-round tire and making it round. The grinder is part of a grinder head assembly which is mounted on the angling means. The grinder head assembly includes the grinder, a housing and a drive mechanism. The drive mechanism includes a motor which drives the grinder wheel so that it grinds the trunnion tire back into round.

48 Claims, 6 Drawing Sheets

GRINDING APPARATUS FOR GRINDING AN OUT-OF-ROUND TRUNNION OR TIRE FOR A ROTARY KILN

BACKGROUND OF THE INVENTION

The present invention relates generally to an apparatus for grinding an out-of-round trunnion or tire for a rotary kiln and, more particularly, to a self-adjusting assembly for grinding an out-of-round trunnion or tire into round.

Tubular rotary kilns are commonly used in the manufacture of cement and pulverized lime and in drying other solid and granular materials. The kilns are supported and rotate on trunnion roller mountings that cooperate with a tire surrounding the shell of the kiln.

Wear on the trunnion rollers is an inevitable consequence of the friction that occurs between the kiln tire and the trunnion rollers. At some point, either the kiln tire or the trunnion rollers will become out-of-round (usually concave). There are several negative consequences to an out-of-round kiln tire or trunnion roller. First, as the wear continues, the contact surface on the kiln tire and the trunnion roller decreases, and the kiln becomes difficult to control. Second, since the trunnion roller turns approximately three times for every revolution of the kiln tire, the surface of the trunnion roller will become harder than the surface of the tire as a result of work hardening. When the hardness relationship between the kiln tire and the trunnion roller is out of balance, spalling occurs on the surface of the kiln tire. Third, if the surfaces of the kiln tire and the trunnion rollers wear to the point that the kiln is not free to move uphill or downhill on the surface of the trunnion roller, the kiln will move in the direction of the kiln thrust. Thus, the shaft of the trunnion roller is forced against a thrust collar or thrust plate and high-heating temperatures will result. Fourth, wear on the surface of the tire or trunnion roller ultimately reduces the operating efficiency of the kiln, and, thus, unnecessarily increases the consumption of energy.

A need exists for a machine to be used on-site to address both the wear of kiln tires and trunnion rollers to place them back in round.

SUMMARY OF THE INVENTION

It is the object of the invention to provide an apparatus for grinding an out-of-round kiln tire or trunnion roller for a rotary kiln back into round. In accordance with this and other objects of the invention, there is provided a mounting bracket for straddling a trunnion roller when the apparatus is grinding an out-of-round kiln tire, a grinding wheel assembly, a means for positioning the grinding wheel assembly in tangent relation to the out-of-round trunnion or tire, and a means for tracking an outside diameter of the out-of-round trunnion roller or kiln tire. The mounting bracket includes a base weldment, a linear mill mount coupled to the base weldment and an assembly for urging the means for tracking an outside diameter against the out-of-round tire trunnion roller or kiln tire. Said means for urging includes an air cylinder operatively coupled to an air cylinder mount which is attached to the linear mill mount. The air cylinder is urged against a channel which is secured to the linear mill mount. The grinding wheel assembly comprises a grinding wheel, a drive assembly for rotating the grinding wheel and a housing for shielding the drive assembly. The means for positioning the grinding wheel assembly so that it is in tangent with the out-of-round trunnion roller or kiln tire includes a cross feed member for translating the grinding wheel head assembly along a first axis, a saddle for the grinding wheel assembly and a means for positioning the saddle at an angle. The means for positioning the saddle at an angle includes a bottom assembly for translating the saddle along a second axis and a top assembly for translating the saddle along a third axis. The means for tracking the diameter of the out-of-round trunnion roller or kiln tire includes a roller which is operatively coupled to the grinding apparatus.

BRIEF DESCRIPTION OF THE DRAWINGS

The above and other objects and advantages of the invention will be more readily apparent from the following detailed description when considered with the accompanying drawing wherein.

DESCRIPTION OF A PERFERRED EMBODIMENT

Figure 1:
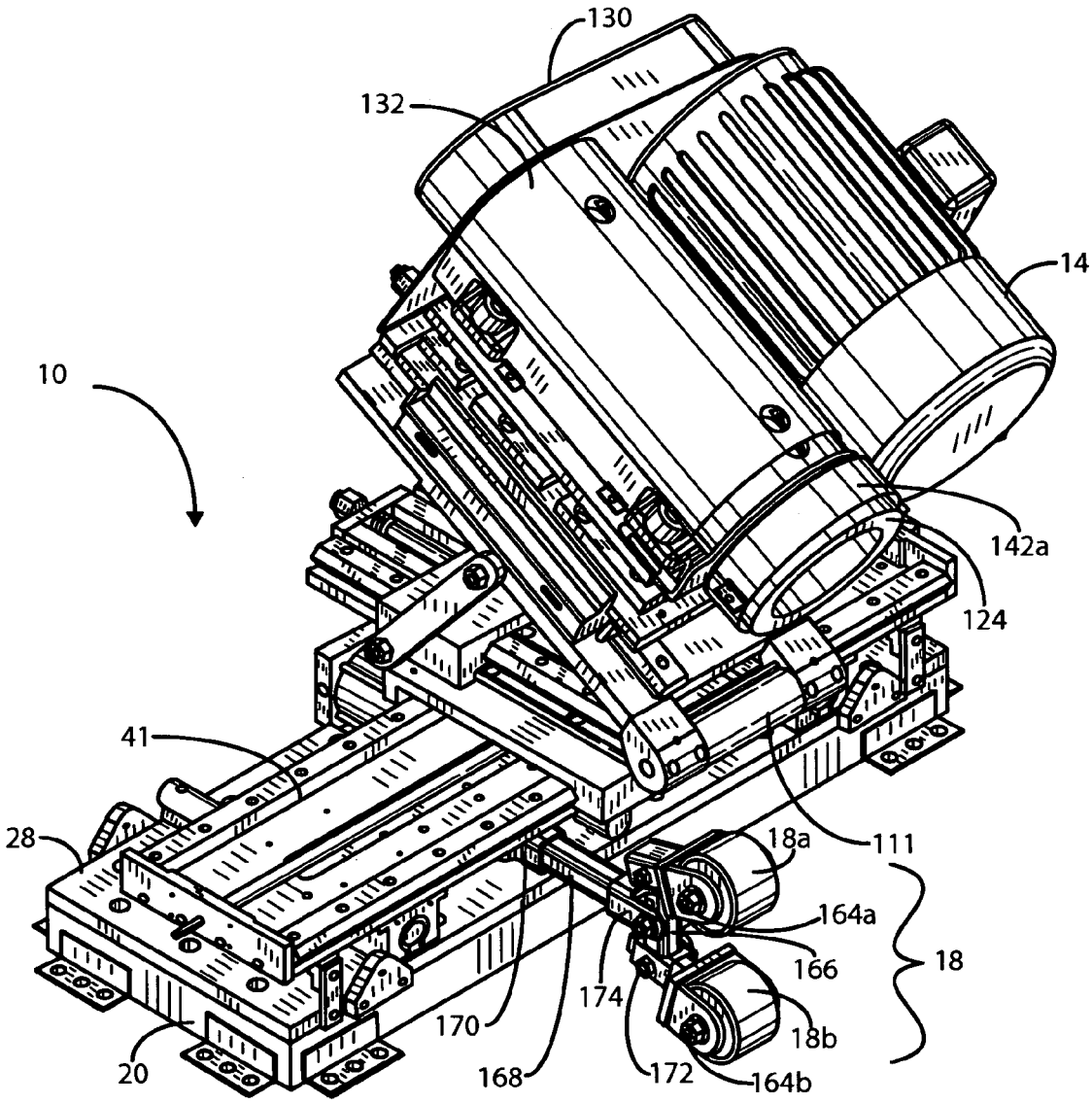
FIG. 1 is a perspective view of the mounting bracket, grinder head assembly, means for positioning the grinding wheel head assembly and means for tracking an outside diameter of a rotary kiln trunnion roller or tire of the present invention.

A grinding apparatus for grinding an out-of-round trunnion roller or kiln tire is shown in FIG. 1 and is generally indicated by numeral 10. The grinding apparatus 10 is comprised of a base weldment 20, a motor and grinding head assembly 14, a positioning assembly and a tracking means 18.

The base weldment 20 supports a linear mill mount 28 which in turn supports the positioning means.

The linear mill mount 28 urges the grinder assembly 10 toward the out-of-round trunnion roller of kiln tire. An air cylinder 30 passes through an air cylinder mount 32 which is coupled to the linear mill mount 28. The air cylinder 30 has a threaded end 36. The threaded end 36 intersects with threaded end bracket 40. The threaded end bracket is fastened to a base plate 42 by a pair of cylindrical rails 38 that are, in turn, secured to linear mill mount 28 by a first grouping of pillow blocks 40(*a*), 40(*b*), 40(*c*) and 40(*d*). The means for positioning the grinding wheel head assembly so that the grinding wheel is tangent to the out-of-round trunnion roller or kiln tire comprises a cross feed member, a saddle and a means for positioning the saddle at an angle. The cross feed member designated by numeral 41 in FIG. 1 includes the base plate 42 and a translational movement assembly. The base plate 42 is rectangular with numeral 44 defining the length sides and numeral 46 defining the width sides. A first pair of single edge slides 48 bolted along the length wide sides 44. A pair of base feed brackets 50 span the width side edges 46 of the base plate 42. The translational movement of the cross feed member 41 is effected by means of a first feed screw 52 which is journaled for rotation in the base feed brackets 50. The first feed screw 52 extends the length of the base plate 42. It is journaled by a first pair of oil impregnated flange bearings 54. When the feed screw 52 is rotated, the traveling nut 56 carries a cross feed saddle 58 in translational movement along the length dimension of the base plate 42. Cross feed saddle 58 is secured to base plate 42 by downwardly extending flanges 58(*a*) and 58(*b*). Downwardly extending flange 58(*a*) curls around one single edge slide 48 while downwardly extending flange 58(*b*) intersects a gib 59 which glides along the other single edge slide 48. The cross feed member 41 thus translates the saddle 58 on which the grinder head assembly 14 rests.

The positioning means serves two functions. First, as previously described, it aligns the grinder head assembly 14 with the trunnion roller or kiln tire. Second, it positions the grinder head assembly 14 so that it is in tangent with the trunnion roller or kiln tire. To that end, the positioning means has a bottom assembly, a top assembly and a pivoting assembly for adjusting the tilt angle of the grinder head assembly 14 so as to be tangent to the trunnion roller or kiln tire. The bottom assembly comprises a lower plate 62 having a pair of width side edges 64*a* and 64*b* and a pair of length side edges 66. A u-shaped groove 68 or channel is formed in the center of the top surface of lower plate 62. A pair of lower plate bars single edge slides 70 are fastened along the length edges 66 of lower plate 62. Lower bracket plate 72 is coupled to the first width end 64(*a*). A second feed screw 74 is disposed in the unshaped groove 68 and is journaled for rotation in the lower bracket plate 72. A second feed nut 76 is operatively coupled to the second feed screw 74 such that rotation of the second feed screw 74 translates the second feed nut 76 along the second feed screw 74. Second feed nut 76 is coupled to angle plate saddle 78 which slides along the lower plate single edge slides 70 when the second feed screw 74 is rotated. The lower plate 62 is mounted on the cross feed saddle 58 such that when the cross feed saddle is translated across base plate 42 by feed screw 52 the bottom assembly moves with it.

Saddle 78 is mounted to a top assembly. The top assembly includes a rectangular upper plate 80, which has a first width end 82(*a*) and a second width end 82(*b*), and two length-side edges 84 and a u-shaped groove or channel 86 that extends inward from the first width end 82(*a*) on the top surface of upper plate 80 proximate the center thereof. Upper plate slide edges 88 are fastened to the upper plate length-side edges 84 and upper bracket plate 90 is bolted to the first width edge 82(*a*) of the plate 80. Third feed screw 92 is journaled for rotation within the u-shaped groove 86. The third feed screw 92 is secured to the upper bracket plate 90 by a jam nut 96 and an oil impregnated bearing 98, with a thrust bearing 100 hex nut 102, bearing lock nut 106 and bearing lock washer 104 completing the assembly. (Second feed screw 74 is secured to the lower plate bracket 72 in an identical manner.) A third feed nut 94 is threaded onto third feed screw 92.

A control saddle 108 is mounted on the upper plate 80 and is translated across the length dimension of the upper plate by the cooperation of the third feet nut 94 with a mating recess (not shown) formed in the undersurface of the control saddle 108. The bottom assembly and the top assembly are connected to one another by a pivot assembly. The pivot assembly includes jack leg brackets 110. Each jack leg bracket 110 has a first end 112 and a second end 114. Each of the second ends 114 of the two jack leg brackets 110 is secured to the side edges of the angle plate saddle 78. They are secured by a hinge pin 118 which passes through the second end 114 and is locked into place by a washer 116 and a nut 120. The first ends 112 of the jack leg brackets 110 are secured to the rectangular upper plate 80 in a similar manner.

Figure 2A:
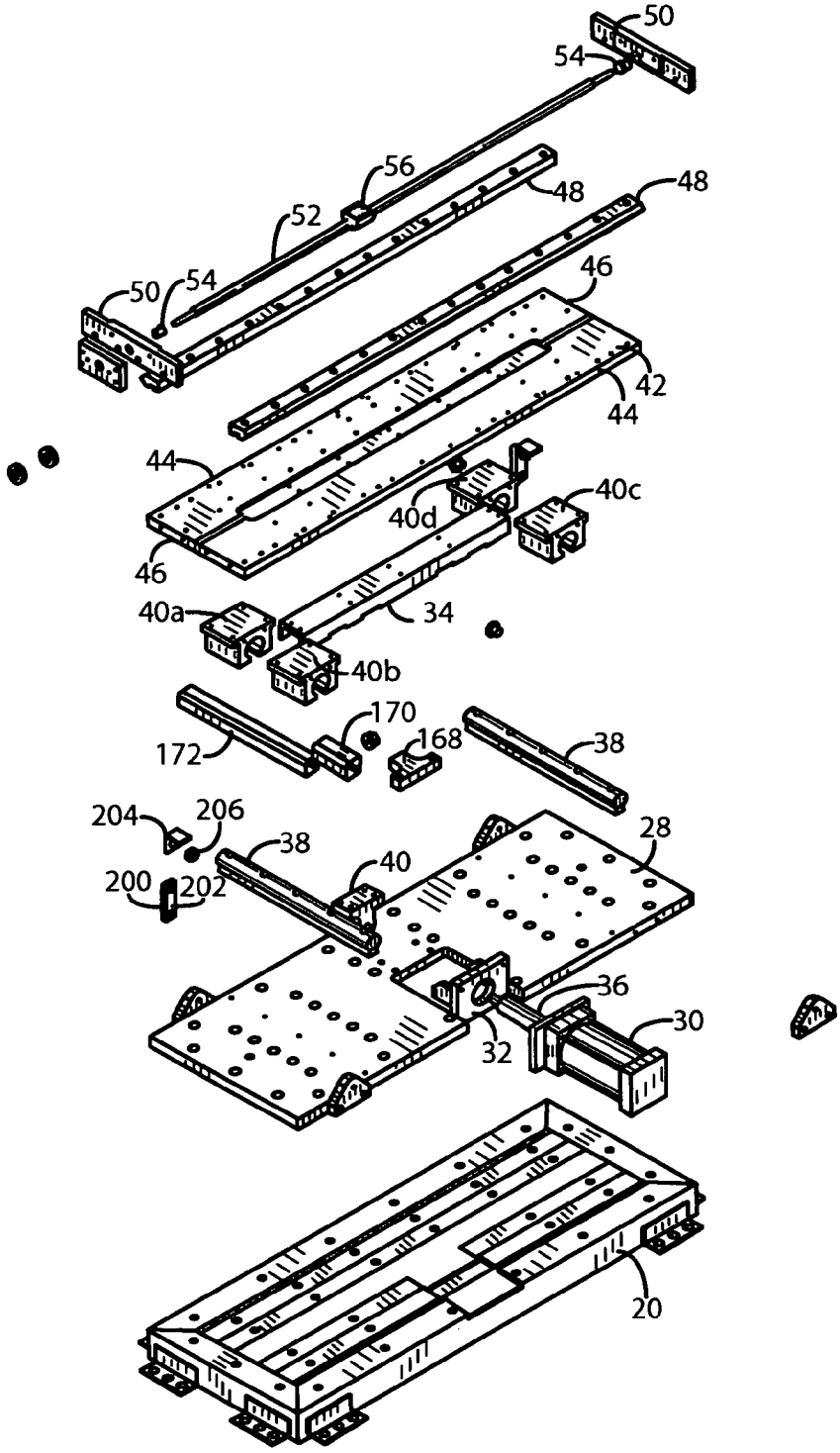
FIG. 2*a* is a partial exploded view showing the grinding wheel head assembly and the positioning assembly.
Figure 2B:
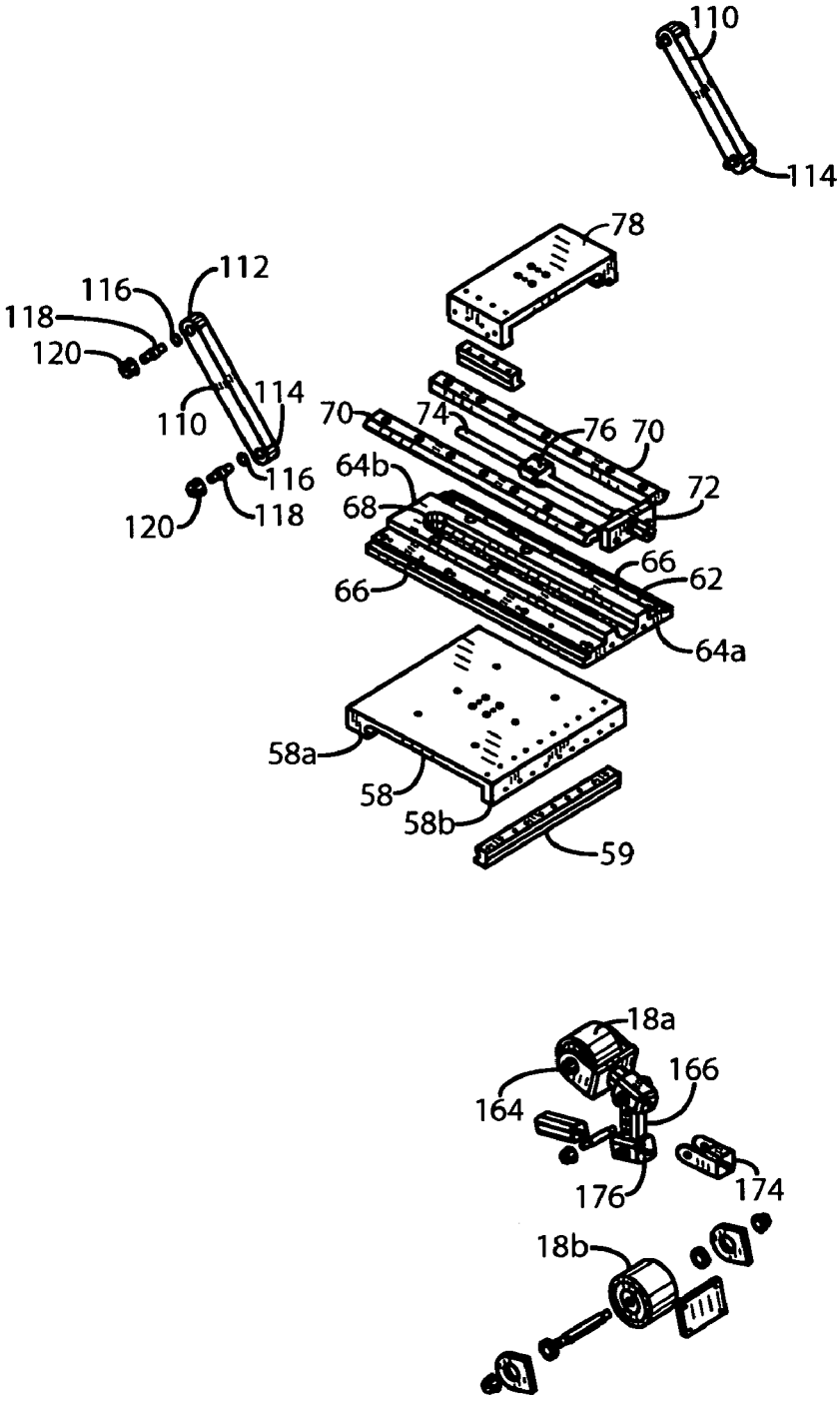
FIG. 2*b* is an exploded view of the tracking assembly and a partial exploded view of the positioning assembly.
Figure 2C:
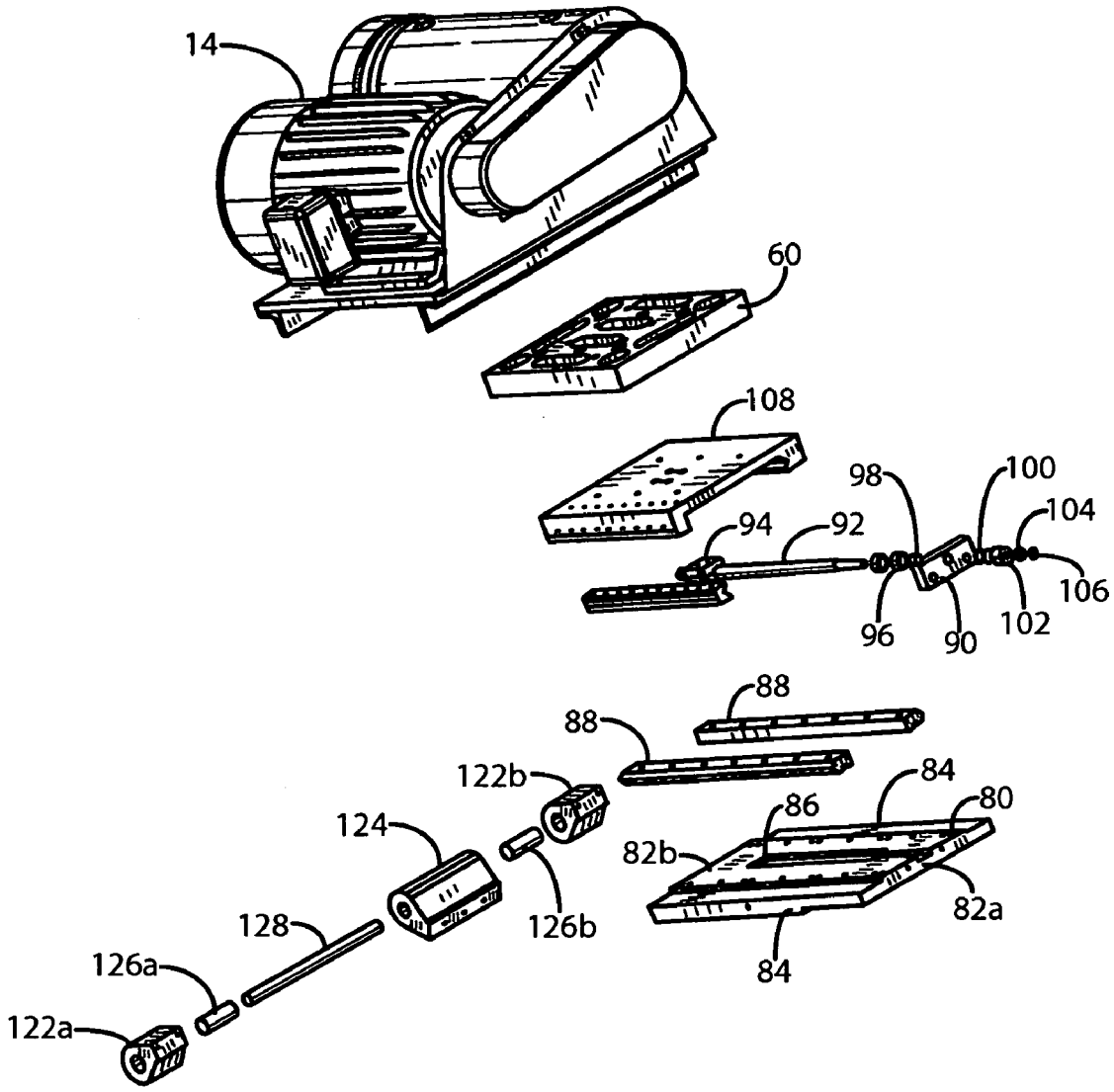
FIG. 2*c* is an exploded view of the positioning assembly and mounting brace.

In addition, the lower plate 62 and the upper plate 80 are secured to one another by hinge member 111 (FIG. 1). The exploded view in FIG. 2*c* shows how hinge member 111 works. First and second upper plate pivot members 122(*a*) and 122(*b*) are secured to upper plate 80 along its second width end 82(*b*). Lower plate pivot 124 is attached to lower plate 62 at second width end 64(*b*). The first and second upper plate pivots 122(*a*) and 122(*b*) are on opposite sides of lower plate pivot 124 and are journaled to one another by a second and third oil impregnated flange bearings 126(*a*) and 126(*b*) that are located between swing pin 128 and the first and second upper plate pivots 122(*a*), 122(*b*) and lower plate pivot 124. Thus, the upper plate 80 and lower plate 62 pivot along hinge 111 and are supported and angled by jack leg brackets 110. As such, the base weldment 20 can be positioned to straddle a trunnion roller. The grinding head assembly 14 is then adjusted to align with the trunnion roller or kiln tire by translating the means for positioning the grinding wheel 16 along the cross feed member 41 and the grinder head assembly 14 is placed in tangent to the trunnion roller by adjusting the angle plate and locking it into place.

Figure 3:
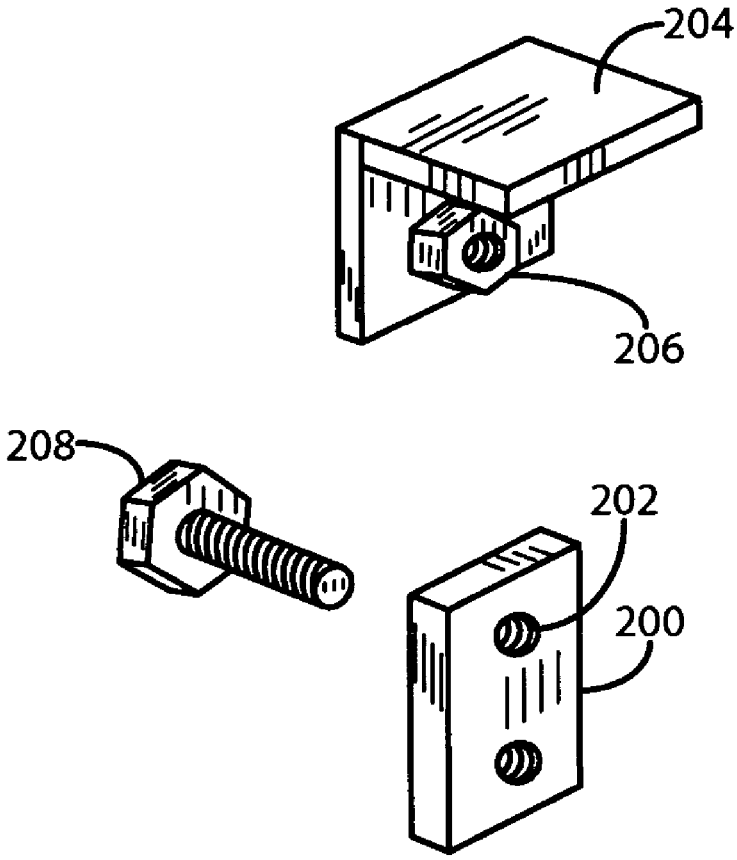
FIG. 3 is a perspective view of the travel stop block and jacking plate of the tracking assembly.
Figure 4:
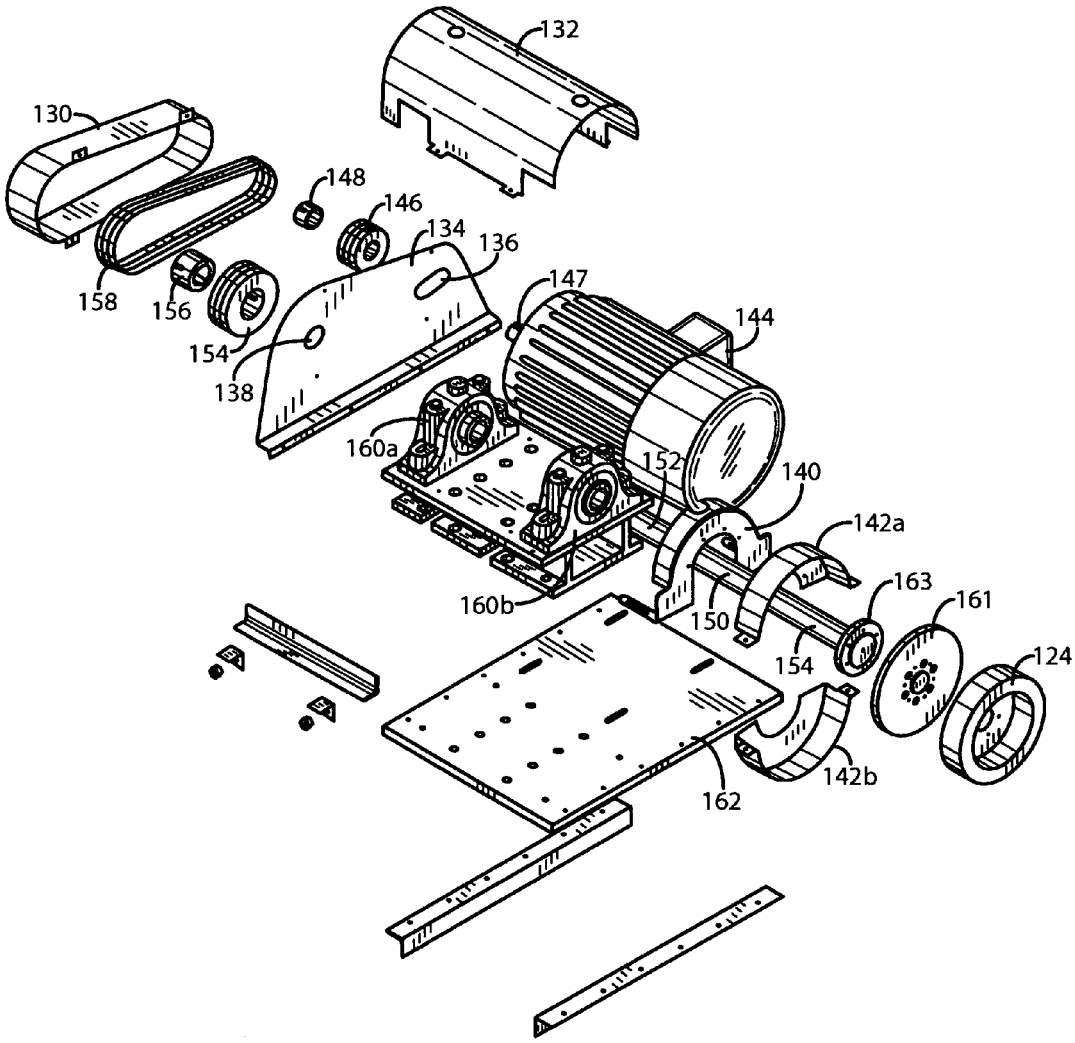
FIG. 4. is an exploded view of the motor and grinding wheel head assembly.

The exploded view of the grinding head assembly 14 shown in FIG. 3 illustrates a housing and driving assembly which drives grinding wheel 124. The housing of the grinding head assembly 14 includes sheave cover shield 130, pillow block cover 132, sheave side shield 134, a moveable grinding wheel shield 140 and upper and lower shields 142(*a*) and 142(*b*).

The drive assembly has a motor 144 whose shaft 147 is coupled to a first taper lock sheave 146. The motor shaft 147 passes through oblong aperture 136 of the sheave side shield and is coupled to first taper lock sheave 146 and it is secured by tapered bushing 148. Running parallel to the motor 144 is arbor 150 which passes through pillow blocks 160*a* and 160*b* and circular aperture 138 in the sheave cover shield 134. A second sheave 154 is attached to first end of the arbor 150 and is held there to by second tapered bushing 156. A plurality of endless belts 158 wrap around first sheave 146 and second sheave 154 such that rotation of motor shaft 147 is transferred to the arbor 150 by rotation of the sheaves 146, 154 and the belt 158.

The arbor 150 is supported and journaled in pillow blocks 160(*a*) and 160(*b*). Disposed at the second end 154 of the arbor 150 is grinding wheel hub 161. The hub 161 is bolted to a flange 163 on the second end of the arbor along with the grinding wheel 124. Thus, the motor rotates the arbor 150, which in turn rotates the grinding wheel 124. The entire assembly is supported by the grinder motor base plate 162.

When fully assembled, the sheave cover 130 covers the first and second sheave 146 and 154, the first and second tapered bushing 148 and 156, as well as the belt 158. The sheaves are separated from the motor 144 and pillow blocks 160(*a*) and 160(*b*) by the sheave side shield 134. Pillow block cover 132 covers the pillow blocks 160(*a*) and 160(*b*) as well as the portion of the arbor shaft extending between the pillow blocks. The remainder of arbor 150 is covered by the moveable shield 140 and the hub 160 and outside diameter of the grinding wheel 124 are covered by the upper and lower grinding wheel shield 142(*a*) and 142(*b*). Base plate 162 is mounted to the spacer 60 that fastens to the saddle member 108 (FIG. 2).

A tracking assembly tracking an outside diameter of an out-of-round trunnion roller or kiln tire is a first and second contact wheel 18*a* and 18*b*. The contact wheels 18*a* and 18*b* are held by roller brackets 164. The roller brackets 164 are coupled together by adjustable pivot arm 166. A roller arm 168 is coupled to the bottom side of the base plate 42 by locking tube 170. The roller brackets 164*a* and 164*b* are coupled together by adjustable roller pivot arm 172. The adjustable roller pivot arm 172 is coupled to the roller pivot bracket 176. The roller pivot bracket 176 is in turn coupled to the roller arm 168 so that the roller pivot bracket 176 pivots as the contract wheels 18*a*, 18*b* track the trunnion roller or kiln tire.

In order to machine an out-of-round trunnion roller, the grinding apparatus 10 is placed adjacent to the trunnion roller. The air ram 30 urges the tracking wheel 18, along with the entire assembly against a trunnion roller. The grinder head assembly 14 is placed in tangent to the trunnion roller and as the trunnion roller is rotated, the grinding wheel 12 grinds the out-of-round trunnion until it is back into round.

The grinding apparatus 10 can also be used to grind a kiln tire as well. To machine a kiln tire the grinding apparatus 10 is positioned to straddle a trunnion roller. Travel stop block 200 is rigidly mounted to linear mill mount 20. Travel stop block has a travel block aperture 202. A jacking plate 204 is fastened to the bottom of base plate 42. Jacking plate 204 has a jacking plate aperture 206. The travel block aperture 202 is aligned with jacking plate aperture 206 and are bolted together by bolt 208. When the jacking plate 204 is fastened to travel stop block 200 the grind apparatus 10 will not track. The tracking rollers 18*a* and 18*b* are removed, and the air ram is not energized. The grinder head assembly 14 is placed in tangent to the kiln tire, and as the kiln tire rotates, the grinding wheel 124 grinds the kiln tire until it is made round.

This invention has been describe herein in considerable detail and in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A grinding apparatus for grinding an out-of-round cylindrical object comprising:

A. a mounting bracket supporting a grinding wheel head assembly including a grinding wheel;

B. a positioning assembly capable of pivoting the grinding wheel head assembly so that the grinding wheel is tangent to the out-of-round cylindrical object; and C. a tracking device for following a contour of the out-of-round cylindrical object, said tracking device being resiliently affixed to said positioning assembly.

2. The grinding apparatus in claim 1 wherein the mounting bracket includes:

A. a base weldment;

B. a linear mill mount coupled to the base weldment, said linear mill mount further supporting an air ram cylinder assembly thereon for urging the tracking device against the contour of the out-of-round cylindrical object.

3. The grinding apparatus in claim 2 where the air ram cylinder assembly includes:

A. an air ram cylinder mount which extends from an upper surface of the linear mill mount, the air ram cylinder mount having an aperture therethrough;

B. an air ram cylinder having a piston with a threaded end extending through said aperture of the air ram cylinder mount;

C. a threaded end bracket affixed to the threaded end of the piston and being secured to the linear mill mount by first and second cylindrical rails which are secured to the linear mill mount and a plurality of pillow blocks slidingly disposed on said rails such that when the air ram cylinder is urged forward through the aperture in the air ram cylinder mount the grinding wheel head assembly is displaced along a first axis.

4. The grinding apparatus in claim 1 where the grinding wheel head assembly comprises a housing, a drive assembly and a grinding wheel.

5. The grinding apparatus as in claim 4 wherein the drive assembly comprises;

A. a motor, having at least one motor shaft;

B. a belt assembly wherein said belt assembly includes a first taper lock sheave operatively coupled to the motor shaft and secured by a first bushing, an arbor, which is parallel to the motor, said arbor having a first and second end where a second taper lock is operatively coupled to the first end of the arbor and secured thereupon by a second bushing and a belt which wraps around the first and second taper lock sheaves such that rotation of the motor shaft is transferred to rotation of the arbor;

C. said arbor being journaled for rotation in a first and second drive assembly pillow block where a hub is operative coupled to the second end of the arbor and said hub is operatively coupled to the grinding wheel such that rotation of the arbor results in rotation of the grinding wheel.

6. The grinding apparatus as is claim 5 where the housing comprises:

A. a sheave cover shield which covers the belt assembly;

B. a pillow block cover which covers the pillow blocks and arbor;

C. a sheave side shield which separates the belt assembly from the motor and pillow blocks, said sheave side shield having an oval-shaped aperture and a circular aperture where the motor shaft extends through the sheave side shield through the oval-shaped aperture and the arbor extends through the sheave side shield through the circular aperture;

D. a moveable grinding wheel shield which is deposed proximate the second end of the arbor;

E. a non-moveable grinding wheel shield which includes an upper shield and a lower shield which combine to shield the outside diameter of the grinding head.

7. The grinding apparatus as in claim 1 wherein the positioning assembly includes a cross feed member, a saddle for the grinder head assembly and an angling assembly.

8. The grinding apparatus as in claim 7, wherein the cross feed member includes a base plate, a transitional movement assembly, and a cross feed saddle.

9. The grinding apparatus as in claim 8, wherein;

A. the base plate includes a first and second end and a pair of lengthwise sides, single edge slides, which are coupled to the lengthwise sides and a first and second feed bracket which are coupled to the first and second end of the base plate;

B. the transitional movement assembly includes a first feed screw which is journaled for rotation in the first and second base feed brackets by a first oil impregnated flange bearing and a first traveling nut that is operatively coupled to the first feed screw;

C. the cross feed saddle is operatively coupled to the first traveling nut, such that when the first feed screw is journaled for rotation, the traveling nut engages the cross feed saddle, allowing for translational movement of the cross feed saddle.

10. The grinding apparatus in claim 7 wherein angling assembly includes a bottom transitional movement assembly, a top transitional movement assembly and an assembly for pivoting the bottom transitional movement assembly and the top transitional movement assembly.

11. The grinding apparatus as in claim 10, wherein the bottom transitional movement assembly includes:

A. a lower plate having a first end and a second end and two lengthwise sides, a pair of lower plate single edge slides coupled to the lengthwise sides of the lower plate, and a lower plate bracket coupled to a second end of the lower plate and a unshaped groove extending from the second end of the lower plate;

B. a second feed screw journaled for rotation in the u-shaped groove of the lower plate and secured to the lower plate by the lower plate bracket where a second feed nut is operatively coupled to the second feed screw;

C. an angling plate saddle which is operatively coupled to the second feed nut such that when the second feed screw is journaled for rotation, the angled plate saddle is carried in translational movement.

12. The grinding apparatus as in claim 10 where the top translational movement assembly includes:

A. an upper plate having a first and second end and two lengthwise side ends, a pair of upper plate single edge slides where each upper plate single edge slide is coupled to each lengthwise side edge, a u-shaped groove extending from the second end of the upper plate, and an upper plate bracket which is mounted on the second end of the upper plate;

B. a third feed screw which is journaled for rotation in the u-shaped groove of the upper plate and is secured to the upper plate by the upper plate bracket;

C. a control saddle which is coupled to the saddle for the grinder head assembly.

13. The grinding apparatus as in claim 10 wherein the pivoting assembly comprises a hinge member and at least one jack leg bracket where the hinge member connects to both the top transitional movement assembly and the bottom transitional movement assembly and at least one jack leg bracket secures the top transitional movement assembly in a locked position at an angle to the bottom transitional movement assembly.

14. The grinding apparatus as in claim 13 where the hinge member includes a first and second upper plate pivot which is connected to the top transitional movement assembly, a lower plate pivot which is attached to the bottom transitional assembly and the first upper plate pivot is at one end of the lower plate pivot and the second upper plate pivot is at another end of the lower plate pivot and a second and third oil impregnated flange bearing is coupled to the first and second upper plate pivot and a swing pin passes through the first upper plate pivot, the lower plate pivot and the second upper plate pivot.

15. The grinding apparatus in claim 1 wherein tracking device includes a contact wheel coupled to a roller bracket which is operatively connected to positioning assembly by a shaft extending from a roller arm plate.

16. The grinding apparatus in claim 1 where the cylindrical object is a rotary kiln tire.

17. The grinding apparatus in claim 1 where the cylindrical object is a trunnion roller.

18. A grinding apparatus for grinding an out-of-round cylindrical object comprising:

A. a grinding wheel head assembly having a grinding wheel;

B. a positioning assembly positioning the grinding wheel head assembly so that the grinding wheel is tangent to the out-of-round cylindrical object;

C. a tracking device following a contour of the out-of-round cylindrical object, said tracking device being resiliently affixed to said positioning assembly; and D. a mounting bracket supporting the grinding wheel head assembly, wherein the mounting bracket includes a base weldment and a linear mill mount supporting an air ram cylinder assembly urging the tracking device against the contour of the out-of-round cylindrical object;

E. wherein the air ram cylinder assembly includes an air ram cylinder mount which extend from an upper surface of the linear mill mount, the air ram cylinder mount having an aperture therethrough; an air ram cylinder having a piston with a threaded end extending through said aperture in the air ram cylinder mount; a threaded end bracket affixed to the threaded end of the piston and secured to the liner mill mount by first and second cylindrical rails which are secured to the linear mill mount and a plurality of pillow blocks slidingly disposed on said rail such that when the air ram cylinder is urged forward through the aperture in the air ram cylinder mount, the grinding wheel head assembly is displaced along a first axis.

19. The grinding apparatus as in claim 18 where the grinding wheel head assembly includes a housing a drive assembly and a grinding wheel.

20. The grinding apparatus as in claim 19 wherein the drive assembly comprises:

A. a motor having at least one motor shaft;

B. a belt assembly wherein said belt assembly includes a first taper lock sheave operatively coupled to a motor shaft and secured by a first bushing, an arbor, which is parallel to the motors said arbor having a first and second end where a second taper lock is operatively coupled to the first end of the arbor and secured thereupon by a second bushing and a belt which wraps around the first and second taper lock sheaves such that rotation in the motor shaft is transferred to rotation of the arbor; and C. said arbor being journaled for rotation in a first and second drive assembly pillow block where a hub is operatively coupled to the second end of the arbor and said hub is operatively coupled to the grinding wheel such that rotation of the arbor results in rotation of the grinding wheel.

21. The grinding apparatus as in claim 20 wherein the housing comprises a sheave cover shield covering the belt assembly; a pillow block cover covering the pillow block and arbor; a sheave side shield which separates the belt assembly from the motor and pillow block, said sheave side shield separating the belt assembly from the motor and pillow blocks said sheave side shield having an oval-shaped aperture and a circular aperture where the motor shaft extends through the sheave side shield through the oval-shaped aperture and the arbor extends through the sheave side shield through the circular aperture; a movable grinding wheel shield which is disposed proximate the second end of the arbor; and a non-movable grinding wheel shield which includes an upper shield and a lower shield which combine to shield the outer diameter of the grinding head.

22. The grinding apparatus as in claim 18 wherein the positioning assembly includes a cross feed member, a saddle for the grinder head assembly and an angling assembly.

23. The grinding apparatus as in claim 22, wherein the cross feed member includes a base plate, a transitional movement assembly and a cross feed saddle.

24. The grinding apparatus as in claim 23 wherein the base plate includes a first and second end a pair of lengthwise sides, single edge slides coupled to the lengthwise sides and a first and second feed bracket which are coupled to the first and second end of the base plate; the transitional movement assembly includes a first feed screw which is journaled for rotation in the first and second base feed brackets by a first oil impregnated flange bearing and a first traveling nut that is operatively coupled to the first feed screw; and the cross feed saddle is operatively coupled to the first traveling nut, such that when the first feed screw is journaled for rotation, the traveling nut engages the cross feed saddle allowing for translational movement of the cross feed saddle.

25. The grinding apparatus as in claim 22 wherein the angling assembly includes a bottom transitional movement assembly, a top transitional movement assembly and an assembly for pivoting the bottom transitional movement assembly and the top transitional movement assembly.

26. The grinding apparatus as in claim 25 wherein the bottom transitional movement assembly includes:

A. a lower plate having a first end and a second end and two lengthwise sides, a pair of lower plate single edge slides coupled to the lengthwise sides of the lower plate, and a lower plate bracket coupled to a second end of the lower plate and a u-shaped groove extending from the second end of the lower plate;

B. a second feed screw journaled for rotation in the u-shaped groove of the lower plate and secured to the lower plate by the lower plate bracket where a second feed nut is operatively coupled to the second feed screw; and C. an angling plate saddle which is operatively coupled to the second feed nut such that when the second feed screw is journaled for rotation, the angled plate saddle is carried in translational movement.

27. The grinding apparatus as in claim 25 wherein the top transitional movement assembly includes:

A. an upper plate having a first and second end and two lengthwise side ends, a pair of upper plate single edge slides where each upper plate single edge slide is coupled to each lengthwise side edge, a u-shaped groove extending from the second end of the upper plate, and an upper plate bracket which is mounted on the second end of the upper plate;

B. a third feed screw which is journaled for rotation in the u-shaped groove of the upper plate and is secured to the upper plate by the upper plate bracket; and C. a control saddle which is coupled to the saddle for the grinder head assembly.

28. The grinding apparatus as in claim 22 wherein the pivoting assembly comprises a hinge member and at least one jack leg bracket where the hinge member connects to both the top transitional movement assembly and the bottom transitional movement assembly and at least one jack leg bracket secures to the top transitional movement assembly in a locked position at an angle to the bottom transitional movement assembly.

29. The grinding apparatus as in claim 28 wherein the hinge member includes a first and second upper plate pivot which is connected to the top transitional movement assembly, a lower plate pivot which is attached to the bottom transitional movement assembly and the first upper plate pivot is at one end of the lower plate pivot and the second upper plate pivot is at another end of the lower plate pivot and a second and third oil impregnated flange bearing is coupled to the first and second upper late pivot and a swing pin passes through the first upper plate pivot, the lower plate pivot and the second upper plate pivot.

30. The grinding apparatus in claim 18 wherein the tracking device includes a contact wheel coupled to a roller bracket which is operatively connected to the positioning assembly by a shaft extending from the roller arm plate.

31. The grinding apparatus as in claim 18 wherein the cylindrical object is a rotary kiln tire.

32. The grinding apparatus as in claim 18 wherein the cylindrical object is a trunnion roller.

33. A grinding apparatus grinding an out-of-round cylindrical object comprising:

A. a grinding wheel head assembly having a grinding wheel;

B. a positioning assembly capable of pivoting the grinding wheel head assembly so that the grinding wheel is tangent to the out-of-round cylindrical object;

C. a tracking device following a contour of the out-of-round cylindrical object; and D. a mounting bracket supporting the grinding wheel head assembly wherein the mounting bracket includes a base weldment supporting a linear mill mount having an air ram cylinder assembly merging the tracking device against the contour of the out-of-round cylindrical object.

34. The grinding apparatus in claim 33 the air ram cylinder assembly includes an air ram cylinder mount which extend from an upper surface of the linear mill mount, the air ram cylinder mount having an aperture therethrough; an air ram cylinder having a piston with a threaded end extending through said aperture in the air ram cylinder mount; a threaded end bracket affixed to the threaded end of the piston and secured to the liner mill mount by first and second cylindrical rails which are secured to the linear mill mount and a plurality of pillow blocks slidingly disposed on said rail such that when the air ram cylinder is urged forward through the aperture in the air ram cylinder mount, the grinding wheel head assembly is displaced along a first axis.

35. The grinding apparatus as in claim 33 wherein the grinding wheel head assembly includes a housing drive assembly and grinding wheel.

36. The grinding apparatus as in claim 35 wherein the drive assembly includes:

A. a motor having at least one motor shaft;

B. a belt assembly wherein said belt assembly includes a first taper lock sheave operatively coupled to a motor shaft and secured by a first bushing an arbors which is parallel to the motor, said arbor having a first and second end where a second taper lock sheave is operatively coupled to the first end of the arbor and secured thereupon by a second bushing and a belt which wraps around the first and second taper lock sheaves such that rotation in the motor shaft is transferred to rotation of the arbor; and C. said arbor being journaled for rotation in the first and second drive assembly pillow block where a hub is operatively coupled to the second end of the arbor and said hub is operatively coupled to the grinding wheel such that rotation of the arbor results in rotation of the grinding wheel.

37. The grinding apparatus as in claim 36 wherein the housing comprises:

A. a sheave cover shield which covers the belt assembly;

B. a pillow block cover which covers the pillow block and arbor;

C. a sheave side shield which separates the belt assembly from the motor and pillow block, said sheave side shield having an oval-shaped aperture and a circular aperture where the motor shaft extends through the sheave side shield through the oval-shaped aperture and the arbor extends through the sheave side shield through the circular aperture;

D. a movable grinding wheel shield which is disposed proximate the second end of the arbor; and E. a non-movable grinding wheel shield which includes an upper shield and a lower shield which combine to shield the outer diameter of the grinding head.

38. The grinding apparatus as in claim 33 wherein the positioning assembly includes a cross feed member, a saddle for the grinder head assembly and an angling assembly.

39. The grinding apparatus as in claim 38 wherein the cross feed member includes a base plate, a transitional movement assembly and a cross feed saddle.

40. The grinding apparatus as in claim 39 wherein the base plate includes a first and second end, a pair of lengthwise sides, single edge slides which are couple to the lengthwise sides and a first and second feed bracket which are coupled to the first and second end of the base plates; the transitional movement assembly includes a first feed screw which is journaled for rotation in the first and second base feed brackets by a first oil impregnated flange bearing and a first traveling nut that is operatively coupled to the first feed screw; and the cross feed saddle is operatively coupled to the first traveling nut, such that when the first feed screw is journaled for rotation, the traveling nut engages the cross feed saddle, allowing for translational movement of the cross feed saddle.

41. The grinding apparatus as in claim 38 wherein the angling assembly includes a bottom transitional movement assembly, a top transitional movement assembly and an assembly for pivoting the bottom transitional movement assembly and the top transitional moving assembly.

42. The grinding apparatus as in claim 41 wherein the bottom transitional movement assembly includes:

A. a lower plate having a first end and a second end and two lengthwise sides, a pair of lower plate single edge slides coupled to the lengthwise sides of the lower plate, and a lower plate bracket coupled to a second end of the lower plate and a u-shaped groove extending from the second end of the lower plate;

B. a second feed screw journaled for rotation in the u-shaped groove of the lower plate and secured to the lower plate by the lower plate bracket where a second feed nut is operatively coupled to the second feed screw; and C. an angling plate saddle which is operatively coupled to the second feed nut such that when the second feed screw is journaled for rotation the angled plate saddle is carried in translational movement.

43. The grinding apparatus as in claim 41 wherein the top transitional movement assembly includes:

A. an upper plate having a first and second end and two lengthwise side ends, a pair of upper plate single edge slides where each upper plate single edge slide is coupled to each lengthwise side edge, a u-shaped groove extending from the second end of the upper plate and an upper plate bracket which is mounted on the second end of the upper plate;

B. a third feed screw which is journaled for rotation in the u-shaped groove of the upper plate and is secured to the upper plate by the upper plate bracket; and C. a control saddle which is coupled to the saddle for the grinder head assembly.

44. The grinding apparatus as in claim 38 wherein the pivoting assembly comprises a hinge member connected to a top transitional movement assembly and the bottom transitional movement assembly and at least one jack leg bracket securing the top transitional movement assembly in a locked position at an angle to the bottom transitional movement assembly.

45. The grinding apparatus as in claim 44 wherein the hinge member includes a first and second upper plate pivot which is connected to the top transitional movement assembly, a lower plate pivot which is attached to the bottom transitional movement assembly, said first upper plate pivot is at one end of the lower plate pivot and the second upper plate pivot is at another end of the lower plate pivot and a third oil impregnated flange bearing is coupled to the first and second upper plate pivot and a swing pin passes through the first upper plate pivot, the lower plate pivot and the second upper plate pivot.

46. The grinding apparatus as in claim 33 wherein the tracking device includes a contact wheel coupled to a roller bracket which is operatively connected to the positioning assembly by a shaft extending from the roller arm plate.

47. The grinding apparatus as in claim 33 wherein the cylindrical object is a rotary kiln tire.

48. The grinding apparatus as in claim 33 wherein the cylindrical object is a trunnion roller.

* * * * *

UNITED STATES PATENT AND TRADEMARK OFFICE

CERTIFICATE OF CORRECTION

PATENT NO. : 7,048,616 B1
APPLICATION NO. : 10/991821
DATED : May 23, 2006
INVENTOR(S) : Martin A Gardzinski and Donato L. Ricci It is certified that error appears in the above-identified patent and that said Letters Patent is hereby corrected as shown below:

Claim 11, column 7, line 12, change “unshaped” to -- u-shaped --.

Claim 19, column 8, line 28, after “housing” insert a comma -- , --.

Claim 20, column 8, line 36, delete “motors” and replace with -- motor, --

Signed and Sealed this

Fifteenth Day of August, 2006

JON W. DUDAS
*Director of the United States Patent and Trademark Office*